US007631844B2

(12) United States Patent
Styles

(10) Patent No.: US 7,631,844 B2
(45) Date of Patent: Dec. 15, 2009

(54) CORNER POTTED PLANT HOLDER

(76) Inventor: Stephen J. Styles, 764 94th Ave. North, Naples, FL (US) 34108

( * ) Notice: Subject to any disclaimer, the term of this patent is extended or adjusted under 35 U.S.C. 154(b) by 0 days.

(21) Appl. No.: 11/828,052

(22) Filed: Jul. 25, 2007

(65) Prior Publication Data

US 2009/0026336 A1 Jan. 29, 2009

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 3/00*** | (2006.01) |
| ***F21V 21/00*** | (2006.01) |

(52) U.S. Cl. ..... 248/220.1; 248/27.8; 248/312; 248/312.1; 248/315; 211/71.01; 47/41.01

(58) Field of Classification Search ..... 248/27.8, 248/220.1, 312, 312.1, 315; 211/71.01; 47/41.01
See application file for complete search history.

(56) References Cited

U.S. PATENT DOCUMENTS

| | | | | |
|---|---|---|---|---|
| 483,069 | A * | 9/1892 | Legg | 108/42 |
| 1,130,300 | A * | 3/1915 | Krager | 248/218.1 |
| 1,219,025 | A | 3/1917 | Mertz | |
| 1,983,060 | A * | 12/1934 | Zuckerman | 248/225.11 |
| 2,470,463 | A * | 5/1949 | Botten | 119/65 |
| 2,968,462 | A * | 1/1961 | Jones | 248/291.1 |
| 3,316,040 | A | 4/1967 | McGann | |
| 3,329,321 | A * | 7/1967 | Moore | 222/465.1 |
| 3,578,205 | A * | 5/1971 | Ballester | 220/694 |
| 4,531,246 | A | 7/1985 | Earley | |
| D280,582 | S | 9/1985 | DelGarbino et al. | |
| 5,094,421 | A * | 3/1992 | Zaccone | 248/493 |
| 5,327,676 | A | 7/1994 | Kosky | |
| 5,349,134 | A * | 9/1994 | Russell | 174/492 |
| D364,527 | S | 11/1995 | Moon | |
| D382,510 | S | 8/1997 | Dallimore | |
| 6,299,116 | B1 * | 10/2001 | Levesque | 248/312.1 |
| 6,431,386 | B1 * | 8/2002 | Hofman et al. | 220/481 |
| 6,672,003 | B2 * | 1/2004 | Park | 47/67 |
| 7,261,264 | B2 * | 8/2007 | Moran | 248/222.11 |
| 2002/0170230 | A1 | 11/2002 | McCartney et al. | |
| 2004/0108426 | A1 * | 6/2004 | Turvey | 248/223.41 |

* cited by examiner

*Primary Examiner*—J. Allen Shriver, II
*Assistant Examiner*—Michael McDuffie
(74) *Attorney, Agent, or Firm*—The Livingston Firm; Edward M. Livingston

(57) ABSTRACT

A corner potted plant holder (1) for holding a pot in a corner (19) having a body (2) with a top surface (26) and a bottom surface (27), an internal perimeter (9) and an external perimeter (10), a first arm (3) and a second arm (4) secured to the body (2), at least one corner securing means (6) for securing the body (2) to the corner (19) and at least one wall securing means (11) for securing the arms (3 and 4) to the walls (20 and 21) that form the corner (19). The internal perimeter (9) has a predetermined shape for the acceptance of a pot (22) having a larger congruent predetermined shape. In this manner, a person may easily secure a potted plant (24) in a corner (19) above a ground surface.

21 Claims, 4 Drawing Sheets

CORNER POTTED PLANT HOLDER

BACKGROUND OF THE INVENTION

This invention relates to potted plant holders, more particularly, a corner potted plant holder that permits a user to easily secure a potted plant in a corner of a room.

The inclusion of flowers, plants and greenery in general in a room adds a decorative touch that makes the room feel warm and inviting. Even if the flowers, plants or greenery are faux, the addition of life-like flora in a room creates an inviting atmosphere.

Currently, if a person desires to display plants in the corner of a room, he/she must either hang the potted plant from the ceiling or use a plant stand. If one hangs the potted plant from the ceiling, then he or she must climb a ladder and secure a mounting device, such as a bracket or hook, to the ceiling, suspends the potted plant from the mounting device and climbs down the ladder. Although the potted plant is now suspended from the ceiling, many people do not like climbing on a ladder for fear of falling off of the ladder which results in injury. In addition, usually the hanging of a potted plant from a ceiling is a two-person chore as the potted plant should be handed to the person climbing the ladder as it is dangerous to climb the ladder while holding the potted plant. Thus, the suspension of a potted plant from a ceiling may be dangerous.

In the alternative, although it may be safer to utilize a corner plant stand in which to display a potted plant in the corner of a room, the amount of available floor space is decreased as the plant stand takes up a predetermined amount of floor space. In addition, there is always a risk of the plant stand tipping over if it is bumped, which is a common occurrence in homes having young children or pets, thereby creating a mess on the floor.

Thus, a need exists for a corner potted plant holder and method that permits a person to easily secure a potted plant in a corner of a room.

The relevant prior art includes the following references:

| U.S. Pat. No. (U.S. unless stated otherwise) | Inventor | Issue/Publication Date |
|---|---|---|
| 1,219,025 | Mertz | Mar. 13, 1917 |
| Des. 280,582 | DelGarbino et al. | Sep. 17, 1985 |
| Des. 364,527 | Moon | Nov. 28, 1995 |
| 2002/0170230 | McCartney et al. | Nov. 21, 2002 |
| 3,316,040 | McGann | Apr. 25, 1967 |
| 5,327,676 | Kosky | Jul. 12, 1994 |
| Des. 382,510 | Dallimore | Aug. 19, 1997 |
| 4,531,246 | Earley | Jul. 30, 1985 |

SUMMARY OF THE INVENTION

The primary object of the present invention is to provide a corner potted plant holder that permits a person to easily secure a potted plant in a corner of a room.

A further object of the present invention is to provide a corner potted plant holder that permits a user to utilize the floor space beneath the corner in which the corner potted plant holder is secured.

A further object of the present invention is to provide a corner potted plant holder that may be hidden by the plant itself when utilized.

The present invention fulfills the above and other objects by providing a corner potted plant holder that permits a person to easily secure a potted plant in a corner of a room. The corner potted plant holder has a body with a top surface and a bottom surface, an internal perimeter and an external perimeter, a first arm and a second arm secured to the body, at least one corner securing means for securing the body to the corner and at least one wall securing means for securing the arms to the walls that form the corner. The corner securing means and wall securing means may be any securing means, such as nails, pins, bolts, etc. The internal perimeter has a predetermined shape for the acceptance of a pot having a larger congruent predetermined shape. In this manner, a person may easily secure a potted plant in a corner above a ground surface.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
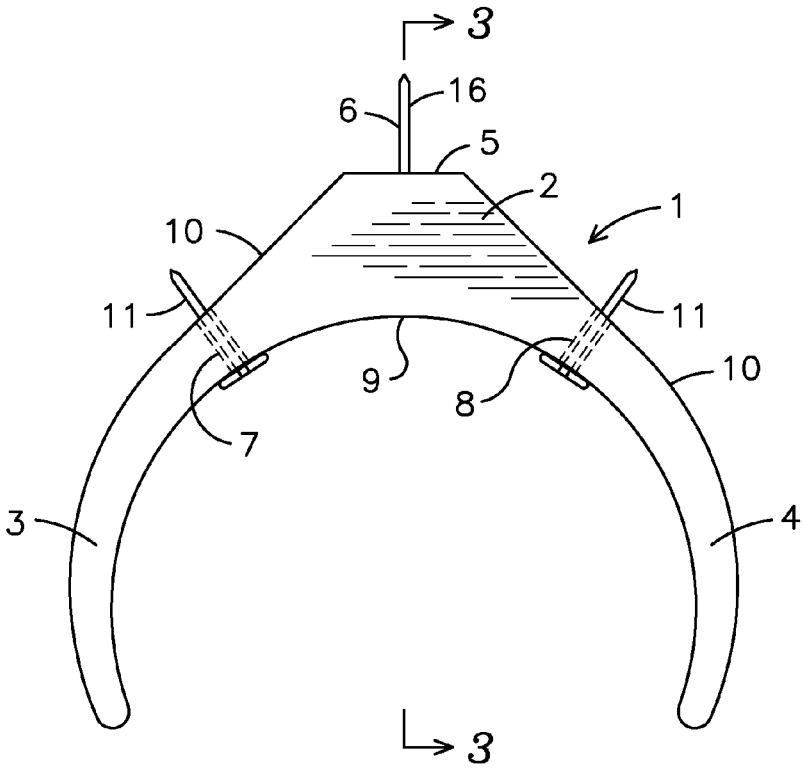
FIG. 1 is a top plan view of the corner potted plant holder of the present invention.

For purposes of describing the preferred embodiment, the terminology used in reference to the numbered components in the drawings is as follows:

| | |
|---|---|
| 1. | corner potted plant holder, generally |
| 2. | body |
| 3. | first arm |
| 4. | second arm |
| 5. | flat portion |
| 6. | corner securing means |
| 7. | first aperture |
| 8. | second aperture |

-continued

| | |
|---|---|
| 9. | internal perimeter |
| 10. | external perimeter |
| 11. | wall securing means |
| 12. | ring |
| 13. | pin |
| 14. | body |
| 15. | head |
| 16. | nail |
| 17. | first recess |
| 18. | second recess |
| 19. | corner |
| 20. | first wall |
| 21. | second wall |
| 22. | pot |
| 23. | lip |
| 24. | plant |
| 25. | predetermined angle |
| 26. | top surface |
| 27. | bottom surface |
| 28. | ground surface |
| 29. | circular internal perimeter |

With reference to FIG. 1, a top plan view of the corner potted plant holder of the present invention is shown. The corner potted plant holder, generally 1 of the present invention includes a body 2 of a predetermined size and shape wherein a first arm 3 and a second arm 4 extend from the body 2. The corner potted plant holder 1 has a predetermined internal perimeter 9 and a predetermined external perimeter 10 wherein the internal perimeter 9 is shaped so as to correspond with a shape of a pot 22 having a larger, congruent shape to permit retention of the pot 22 within the corner potted plant holder 1 (see FIG. 14). Preferably, the internal perimeter 9 is curved as most pots are round in shape; however, the internal perimeter 9 may be of any shape or size so as to accommodate various shapes and sizes of pots, such as the square shape illustrated in FIG. 9. The body 2 may include a flat portion 5 wherein a corner securing means 6, which is preferably a nail 16, is located. A first aperture 7 preferably extends through the first arm 3 while a second aperture 8 preferably extends through the second arm 4. The apertures 7 and 8 permit a user to insert a wall securing means 11 through the corner potted plant holder 1, thereby permitting a user to secure the corner potted plant holder 1 to a first wall 20 and a second wall 21 which form a corner 19 (see FIGS. 11-14). The corner securing means 6 and/or wall securing means 11 may be a nail 16, pin 13 (as shown in FIGS. 2 and 3), bolt or any other securing means.

Figure 2:
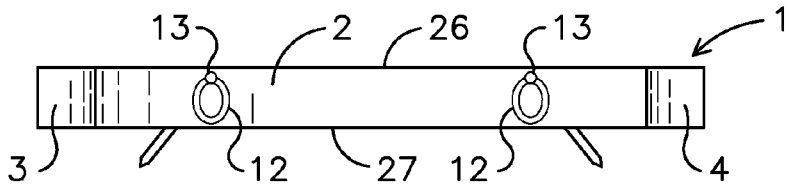
FIG. 2 is a front view of FIG. 1.

In FIG. 2, a front view of FIG. 1 is shown. The corner potted plant holder 1 has a top surface 26 and a bottom surface 27. The wall securing means 11 which extend through the first and second arms 3 and 4 may be a pin 13 having a ring 12 attached thereto. The ring 12 makes it easier to install the invention without tools as a user may use his or her fingers to insert and remove the pin 13.

Figure 3:
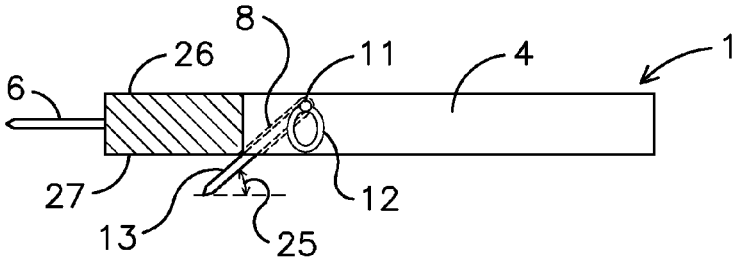
FIG. 3 is a plan cross-sectional view along line 3-3 of FIG. 1.

Next, FIG. 3 shows a plan cross-sectional view along line 3-3 of FIG. 1. The second aperture 8 preferably extends through the second arm 4 at a predetermined angle 25 respective to the bottom surface 27 so as to provide greater strength and stability when the corner potted plant holder 1 is used to hold a pot 22 having a plant 24 (see FIG. 14). Because the pot 22 and plant 24 exert a downward force on the corner potted plant holder 1, the use of the wall securing means 11 at a predetermined angle 25 will be able to withstand a greater weight and force as compared to the apertures 7 and 8 and wall securing means 11 extending through the arms 7 and 8 in a parallel direction to the bottom surface 27.

Figure 4:
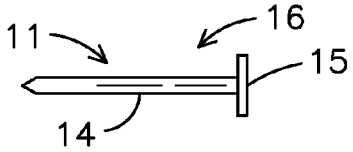
FIG. 4 a side view of an alternate wall securing means of the present invention.
Figure 5:
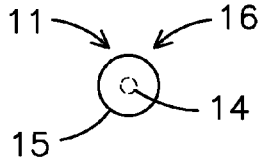
FIG. 5 is a front plan view of the wall securing means of FIG. 4.

In FIGS. 4 and 5, varying views of an alternate wall securing means of the present invention are shown. The wall securing means 11 may be a nail 16 having a body 14 and head 15. The body 14 extends through the arms 7 and 8 of the corner potted plant holder 1 to secure the corner potted plant holder 1 to the walls 20 and 21 as shown in FIGS. 11-14.

Figure 6:
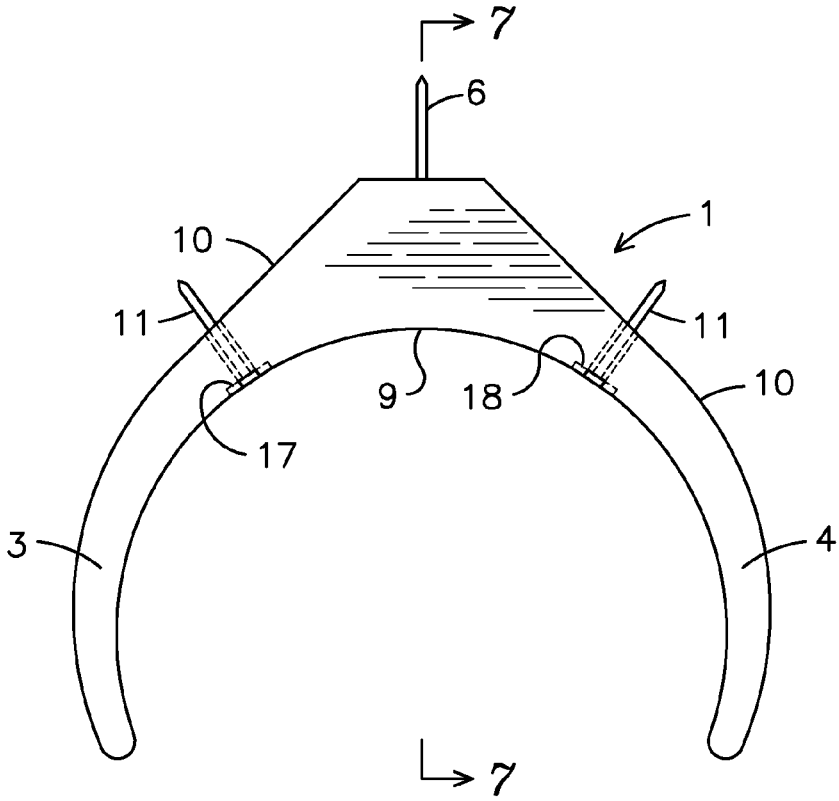
FIG. 6 is a top plan view of the corner potted plant holder of the present invention with another wall securing means.

Next, FIG. 6 shows a top plan view of the corner potted plant holder of the present invention with an alternate wall securing means. The corner potted plant holder 1 includes a first recess 17 located on the first arm 3 and a second recess 18 located on the second arm 4.

Figure 7:
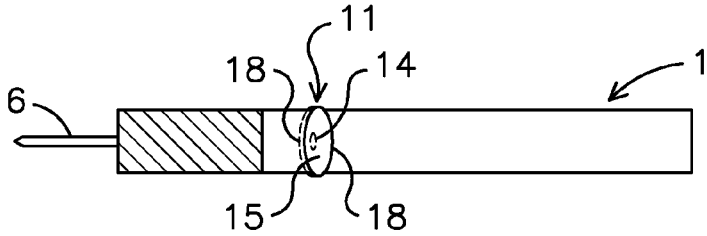
FIG. 7 is a plan cross-sectional view along line 7-7 of FIG. 6.

In FIG. 7, a plan cross-sectional view along line 7-7 of FIG. 6 is shown. The recess 18 is sized and shaped for the accommodation of a wall securing means 11 wherein the head 15 is retained within a portion of the recess 18.

Figure 8:
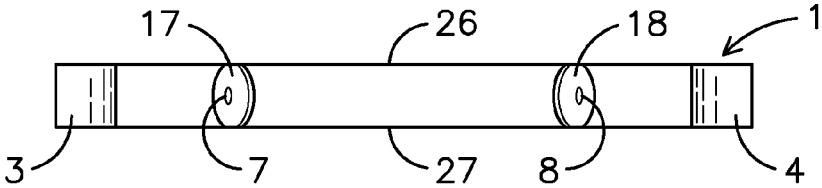
FIG. 8 is a front view of FIG. 6.

With reference to FIG. 8, a front view of FIG. 6 is shown. The recesses 17 and 18 surround the apertures 7 and 8 so as to permit a user to easily insert a wall securing means 11 through the apertures 7 and 8. In addition, the apertures 7 and 8 of the potted plant holder 1 extend through the arms 3 and 4 in a parallel direction to the bottom surface 27 of the corner potted plant holder 1.

Figure 9:
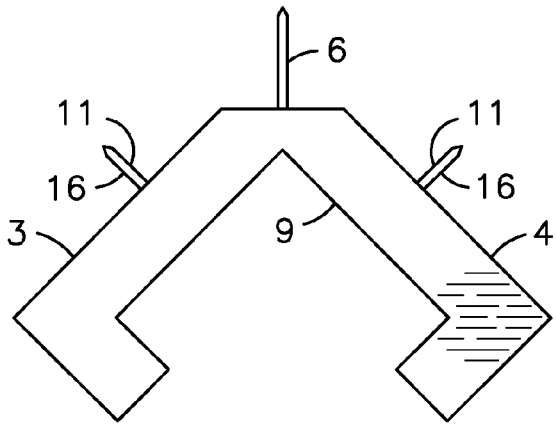
FIG. 9 is a top view of the corner potted plant holder of the present invention having a substantially square shape.

In FIG. 9, a top view of the corner potted plant holder of the present invention is shown having a rectangular shape. The corner potted plant holder 1 includes an internal perimeter 9 that has at least one ninety degree angle for the accommodation of square or rectangular pots. In addition, rather than extending through the arms 3 and 4, the wall securing means 11 extend directly from the arms 3 and 4 and may be nails 16. In this manner, a user need not insert the wall securing means 11 through the arms 3 and 4 in order to use the corner potted plant holder 1 of the present invention.

Figure 10:
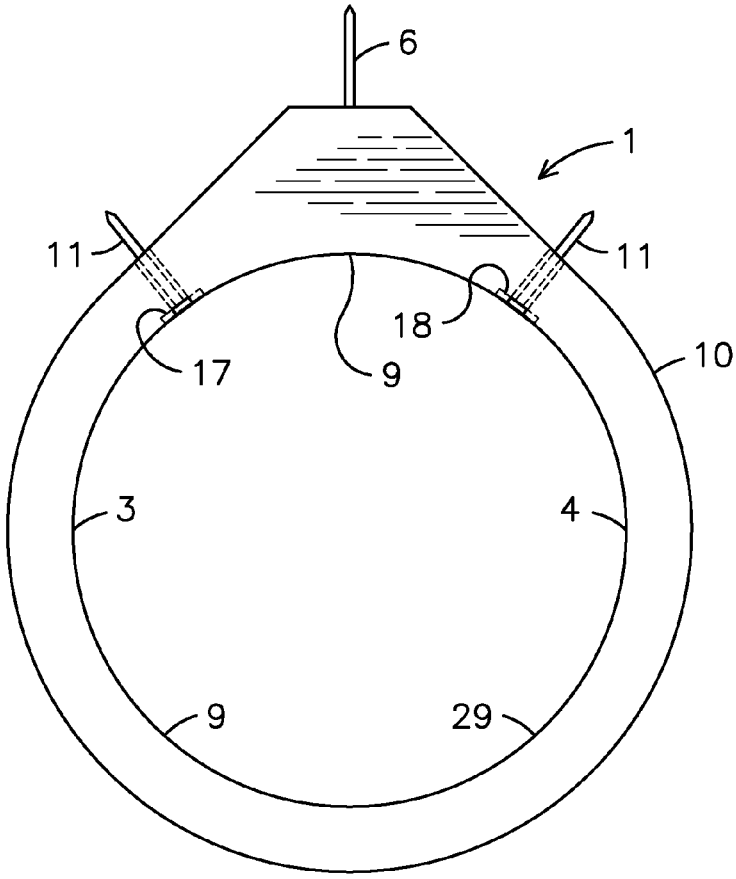
FIG. 10 is a top plan view of the corner potted plant holder of the present invention with a circular internal perimeter.

With reference to FIG. 10, a top plan view of the corner potted plant holder of the present invention with a circular internal perimeter is shown. The corner potted plant holder 1 includes an internal perimeter 9 having a substantially circular internal perimeter 29 formed by the first arm 3 and the second arm 4 joining together. Although not shown, other internal perimeters 9 may be square, triangular or any other shape wherein the arms 3 and 4 join together to form the internal perimeter 9.

Figure 11:
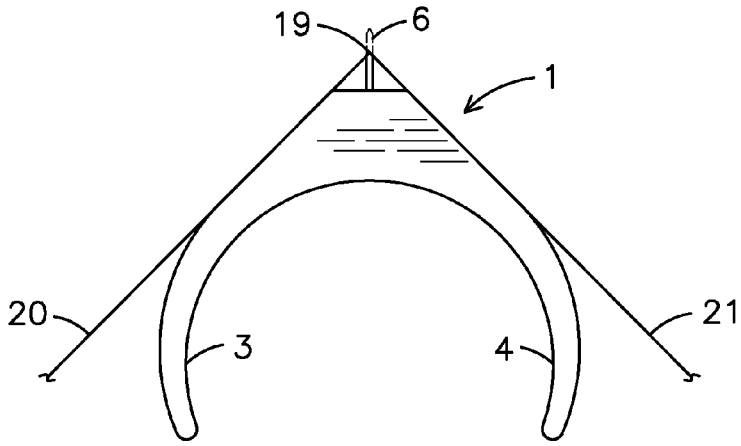
FIG. 11 is a top view of a first step of securing a corner potted plant holder of the present invention in a corner.

To install the corner potted plant holder 1 of the present invention, a user first positions the corner securing means 6 against a corner 19 formed by a first wall 20 and an intersecting second wall 21 as shown in FIG. 11.

Figure 12:
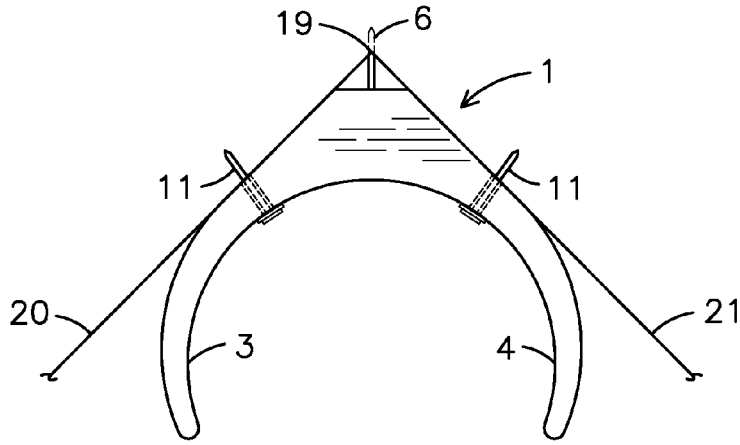
FIG. 12 is a top view of a second step of securing a corner potted plant holder of the present invention in a corner.
Figure 13:
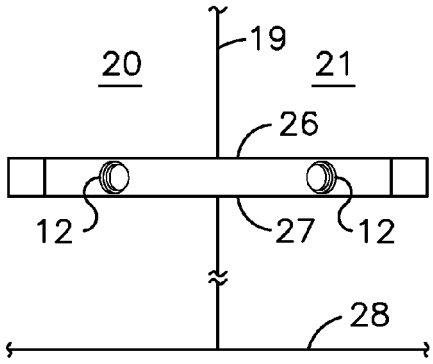
FIG. 13 is a front view of a corner potted plant holder of the present invention installed in a corner.

Then, if using the corner potted plant holder 1 having apertures 7 and 8 in the arms 3 and 4, the inserts the wall securing means 11 through the apertures 7 and 8 and inserts the wall securing means 11 into the walls 20 and 21 to secure the corner potted plant holder 1 to the walls 20 and 21 as shown in FIG. 12. In the alternative, if using the corner potted plant holder 1 without apertures 7 and 8, the user secures the wall securing means 11 directly to the walls 20 and 21. Preferably, the corner potted plant holder 1 is installed such that the bottom surface 27 is parallel to a ground surface 28 as shown in FIG. 13.

Figure 14:
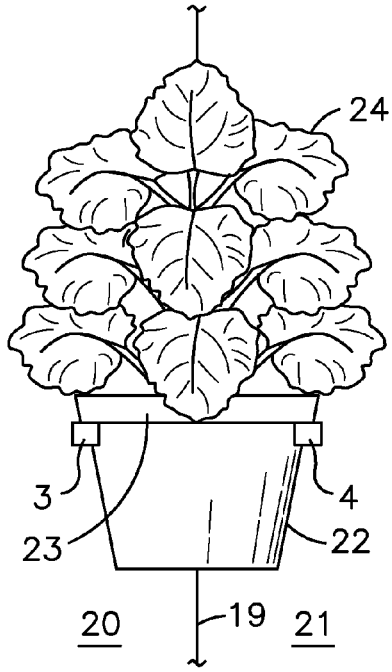
FIG. 14 is a front view of an installed corner potted plant holder of the present invention in use.

Finally, FIG. 14 shows a front view of an installed corner potted plant holder of the present invention in use. The corner potted plant holder 1 may be secured to a corner 19 of a room at any height. When the corner potted plant holder 1 is installed in a corner 19 of a room, the arms 3 and 4 extend a predetermined distance away from the walls 20 and 21. The user inserts a pot 22 having predetermined shape, which may be round, square, rectangular, etc., into the corner potted plant holder 1 such that a lip 23 of the pot 22 rests upon a predetermined portion of the arms 3 and 4. The arms 3 and 4 wrap around the pot 22 a predetermined distance so as to retain the pot 22 adjacent to the internal perimeter 9 of the corner potted plant holder 1. Thus, when a pot 22 is placed within a corner potted plant holder 1 secured to a corner 19, the wall securing means 11 are held in place by the pot 22 and, accordingly, the pot 22 prevents the wall securing means 11 from pulling out of the walls 20 and 21.

A plurality of corner potted plant holders 1 may also be utilized in a single corner. Thus, if the plants 24 located within the pots 22 hang over the side of the pots 22 and a plurality of corner potted plant holders 1 are used in a single corner, the plants 24 will have a cascading appearance.

Because the corner potted plant holder 1 of the present invention utilizes corner securing means 6 and wall securing means 11 which do not require a user to make any structural changes to the corner 19 or walls 20 and 21 and the corner securing means 6 and wall securing means 11 are easily insertable into the corner 19 and/or walls 20 and 21, thus not requiring tools for installation of the corner potted plant holder 1, a user may easily secure, remove and re-use the corner potted plant holder 1 in any corner 19.

The use of the present invention will allow a person to easily secure a potted plant in a corner of a room.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not be considered limited to what is shown and described in the specification and drawings.

Having thus described my invention, I claim:

1. A corner potted plant holder for holding a pot in a corner formed of an intersecting first wall and second wall, said comer potted plant holder comprising:

a body having a predetermined size and shape;

said body having a top surface and a bottom surface;

said body having an internal perimeter and an external perimeter;

said internal perimeter having a predetermined shape for acceptance of a pot having a larger congruent predetermined shape;

a first arm secured to said body;

at least one first aperture extending through said first arm:

a second arm secured to said body;

at least one second aperture extending through said second arm;

at least one corner securing means for securing said body to a corner; and at least one wall securing means for securing at least one arm to a wall adjacent to said corner.

2. The corner potted plant holder of claim 1 wherein:

said first arm and said second arm join together to form said internal perimeter.

3. The corner potted plant holder of claim 1 wherein:

said internal perimeter has a curved shape.

4. The corner potted plant holder of claim 2 wherein:

said internal perimeter has a round shape.

5. The corner potted plant holder of claim 1 wherein:

said at least one corner securing means is a nail.

6. The corner potted plant holder of claim 2 wherein:

said at least one corner securing means is a nail.

7. The corner potted plant holder of claim 1 wherein:

said at least one wall securing means for securing at least one arm to a wall adjacent to said corner is a nail.

8. The corner potted plant holder of claim 2 wherein:

said at least one wall securing means for securing at least one arm to a wall adjacent to said corner is a nail.

9. The corner potted plant holder of claim 2 further comprising:

at least one aperture extending through said second arm.

10. The corner potted plant holder of claim 1 wherein:

said at least one aperture extends through said first arm at a predetermined angle respective to said bottom surface.

11. The corner potted plant holder of claim 1 wherein:

said at least one aperture extends through said second arm at a predetermined angle respective to said bottom surface.

12. The corner potted plant holder of claim 9 wherein:

said at least one aperture extends through said second arm at a predetermined angle respective to said bottom surface.

13. The corner potted plant holder of claim 1 further comprising:

at least one recess surrounding said at least one aperture on said second arm.

14. A corner potted plant holder for holding a pot in a corner formed of an intersecting first wall and second wall, said corner potted plant holder comprising:

a body having a predetermined size and shape;

said body having a top surface and a bottom surface;

said body having an internal perimeter and an external perimeter;

said internal perimeter having a predetermined shape for acceptance of a pot having a larger congruent predetermined shape;

a first arm secured to said body;

at least one aperture extending through said first arm;

a second arm secured to said body;

at least one aperture extending through said second arm;

at least one corner securing means for securing said body to a corner; and at least one wall securing means for securing at least one arm to a wall adjacent to said corner.

15. The corner potted plant holder of claim 14 wherein:

said first aperture extends through said first arm at a predetermined angle respective to said bottom surface; and said second aperture extends through said second arm at a predetermined angle respective to said bottom surface.

16. The corner potted plant holder of claim 14 wherein:

said first arm and said second arm join together to form said internal perimeter.

17. A corner potted plant holder for holding a pot in a corner formed of an intersecting first wall and second wall, said corner potted plant holder comprising:

a body having a predetermined size and shape;

said body having a top surface and a bottom surface;

said body having an internal perimeter and an external perimeter;

said internal perimeter having a predetermined shape for acceptance of a pot having a larger congruent predetermined shape;

a first arm secured to said body;

a first aperture extending through said first arm;

a second arm secured to said body;

a second aperture extending through said second arm;

at least one corner securing means for securing said body to a corner; and at least one wall securing means for securing said first arm to a first wall adjacent to said corner wherein said at least one wall securing means extends through said first aperture; and at least one wall securing means for securing said second arm to a second wall adjacent to said corner wherein said at least one wall securing means extends through said second aperture.

18. The corner potted plant holder of claim 17 wherein:

said first aperture extends through said first arm at a predetermined angle respective to said bottom surface; and said second aperture extends through said second arm at a predetermined angle respective to said bottom surface.

19. The corner potted plant holder of claim 17 wherein:

said first arm and said second arm join together to form said internal perimeter.

20. The corner plant holder of claim 1 further comprising:

at least one recess surrounding said at least one aperture on said first arm.

21. The corner plant holder of claim 20 further comprising:

at least one recess surrounding said at least one aperture on said second arm.

* * * * *